US006463592B1

(12) United States Patent
Brooks

(10) Patent No.: US 6,463,592 B1
(45) Date of Patent: Oct. 15, 2002

(54) MULTIPLY CONFIGURABLE HEAD WEAR

(76) Inventor: Patrick Brooks, P.O. Box 2917, Bremereton, WA (US) 98310

( * ) Notice: Subject to any disclaimer, the term of this patent is extended or adjusted under 35 U.S.C. 154(b) by 12 days.

(21) Appl. No.: 09/828,042

(22) Filed: Apr. 7, 2001

(51) Int. Cl.[7] ..... A42B 1/00
(52) U.S. Cl. ..... 2/209.12
(58) Field of Search ..... 2/209.11, 209.12, 2/209.13, 173, 202, 206, 200.1

(56) References Cited

U.S. PATENT DOCUMENTS

| | | | | | |
|---|---|---|---|---|---|
| 978,048 | A | | 1/1910 | Hendrickson | |
| 1,915,092 | A | | 12/1932 | Hendrickson | |
| 2,133,619 | A | * | 10/1938 | Hutton | 2/209.11 |
| 2,143,265 | A | | 1/1939 | Goldstein | 2/201 |
| 2,735,110 | A | | 2/1956 | Baker | 2/198 |
| 4,141,229 | A | * | 2/1979 | Sharpe | 66/171 |
| 5,659,896 | A | * | 8/1997 | Taylor | 2/12 |
| 6,026,514 | A | * | 2/2000 | Fricker | 2/209.11 |

* cited by examiner

*Primary Examiner*—John J. Calvert
*Assistant Examiner*—Katherine Moran
(74) *Attorney, Agent, or Firm*—Charles J. Rupnick

(57) ABSTRACT

A multiply configurable hat having a visor assembly joined to a double thickness knit stocking cap. The visor assembly is formed of a visor or bill portion joined to an adjustable headband and is separable from the stocking cap and is independently wearable as a visor. The visor assembly is installed into the annular space between the inner and outer knit fabric tubes of the double thickness knit stocking cap and is movable therein relative to the inner and outer knit fabric tubes. Furthermore, the inner and outer knit fabric tubes are configurable relative to the visor assembly, such that the visor portion is arranged in proximity to the brim and the headband is movable along a length of the annular space. The inner and outer knit fabric tubes of the stocking cap are thus configurable relative to the visor assembly into a variety of different arrangements.

20 Claims, 5 Drawing Sheets

MULTIPLY CONFIGURABLE HEAD WEAR

BACKGROUND OF THE INVENTION

The present invention relates generally to head wear and particularly, to multiply configurable head wear having a knit cap combined with a visor assembly.

Different configurations of configurable hats have been known over time. In 1910, Monoson disclosed in U.S. Pat. No. 978,048 a configurable fur hat that, as best understood, had a pliable brim and pliable crown joined at the base of the crown with an unstretchable band and a stiff peak sewn into the brim which could be flipped up or down. Monoson provided a draw cord for adjusting the size of the hat to suit different wearers.

A 1933 Hendrickson U.S. Pat. No. 1,915,092 disclosed a hat formed of a stretchable knit tube with one end closed to form a crown. As best understood, Hendrickson provided two relatively elastic reinforcing bands: a first annular French welt formed as an integral sweat band intermediate along the tubular length, and a second integrally-formed annular French welt at the opening. A wire inserted into the annular ring formed in the second French welt was used to stretch the opening to a much larger size than the original knit tube and to shape the hat brim.

Goldstein disclosed in 1939 U.S. Pat. No. 2,143,265 an attempt to convert an ordinary double-thickness knit "stocking" cap into a visored "hockey" cap which was to be wearable in various configurations. As best understood, Goldstein confined a crescent-shaped peak or visor stiffener sewn in a pocket at the brim between the cap's inner and outer layers.

Later, U.S. Pat. No. 2,735,110 issued to Baker in 1956 disclosed a "scarf" cap using a visor assembly of a stiff visor with an adjustable headband attached thereto. As best understood, the visor assembly is centered at the long edge of a triangular fabric scarf and secured thereto by stitching.

All of the Monoson, Hendrickson, Goldstein, and Baker patents are incorporated in their entirety herein by reference.

SUMMARY OF THE INVENTION

The present invention overcomes limitations of the prior art by providing a multiply configurable hat having a visor assembly joined to a conventional rib-knit stocking cap. The visor assembly is formed of a visor or bill portion joined to an adjustable headband. The visor assembly is separable from the stocking cap and is independently wearable as a visor. The stocking cap is formed of an inner knit fabric tube and an outer knit fabric tube joined together at a first end to form a brim and joined at a second end to form a closure at a crown of the hat. An annular space is thereby formed between the inner and outer knit tubes of the stocking cap. The inner tube is formed with an access aperture structured to accept the visor assembly therethrough into the space formed between the inner and outer knit fabric tubes. The visor assembly is installed in the annular space between the inner and outer knit fabric tubes and is movable therein relative to the inner and outer knit fabric tubes. Furthermore, the inner and outer knit fabric tubes are configurable relative to the visor assembly, such that the visor portion arranged in proximity to the brim, and the headband is movable along a length of the tube. The inner and outer knit fabric tubes of the stocking cap are thus configurable relative to the visor assembly into different arrangements and styles.

According to other aspects of the invention, various methods are provided for forming a multiply configurable visored cap from a double thickness knit stocking cap having an inner tubular thickness and an outer tubular thickness joined together at a crown portion, the inner and outer tubular thicknesses forming an annular space therebetween coextensive therewith and joined together to form at a brim portion opposite the crown portion an opening sized to fit onto a user's head in combination with a visor assembly having a crescent shaped bill projecting from a headband. The headband adjustable to fit a variety of head sizes. One method of the invention includes installing the visor assembly into the space formed between the inner and outer tubular thicknesses, such that an outer most edge of the crescent shaped bill is positionable at an interior crease formed at the brim portion, and the adjustable headband attached thereto is extendable about an interior circumference of the annular space between the inner and outer tubular thicknesses and is selectably positionable along a length of the annular space between the brim portion and the crown portion.

According to one aspect of the invention, the method includes forming a pair of lips in the inner tubular thickness of the cap, whereby access is gained to the annular space between the inner and outer tubular thicknesses of the stocking cap. The method optionally includes finishing edges of the lips by stitching.

According to another aspect of the invention, method optionally includes inserting the visor assembly between the pair of lips into the space between the inner and outer tubular thicknesses of the stocking cap.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

In the Figures, like numerals indicate like elements.

Figure 1:
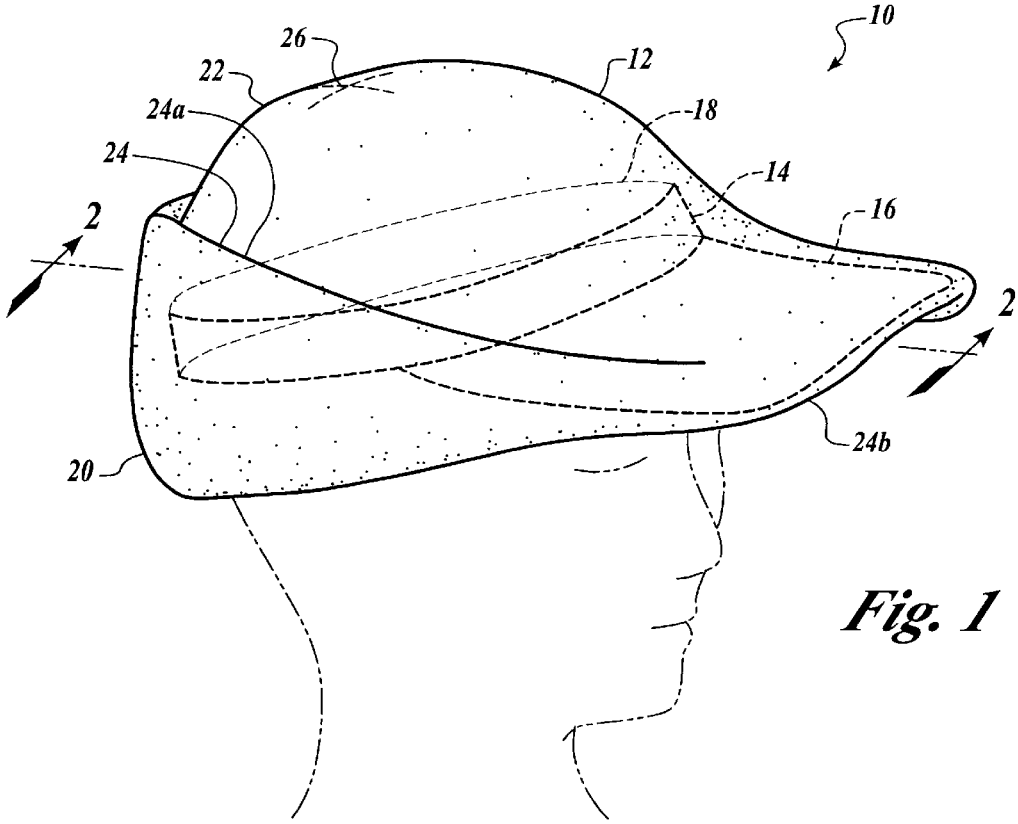
FIG. 1 illustrates one embodiment of the multiply configurable hat of the invention in one of the multiple configurations provided by the invention.
Figure 2:
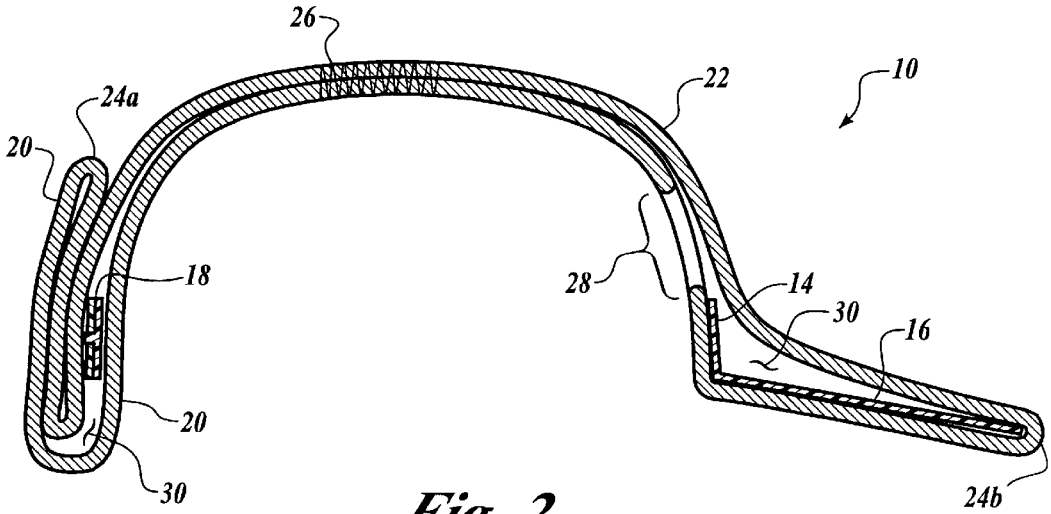
FIG. 2 is a section view taken along the centerline of the hat of the invention as configured in FIG. 1.

FIG. 1 illustrates one embodiment of the multiply configurable hat 10 of the invention in one of the multiple configurations provided by the invention. As illustrated in FIG. 1, the multiply configurable hat 10 of the invention includes a double-layer knit fabric stocking cap 12 in combination with a visor assembly 14. The visor assembly 14 is formed of a visor portion 16, also known as a "bill," joined to a headband 18. The stocking cap 12 is of conventional design, having, for example, knit pearl joining knit ribbons into inner 20 and outer 22 knit fabric tubes, which provides elasticity and a close fit. The inner 20 and outer 22 knit fabric tubes are joined at one end to form a brim 24 at an opening into the hat 10 and are joined at the other end to form a neat appearing closure at the crown 26. The inner 20 and outer 24 knit tubes can also be described as a single knit tube folded back on itself at its middle to form the brim 24 and having the two ends sewn together on the underside to form the closure at the crown 26 at the top of the knit stocking cap 12. An annular space, clearly illustrated in FIG. 2, is formed between the inner 20 and outer 22 knit tubes. The visor assembly 14 is installed in the space between the inner 20 and outer 22 knit tubes and is movable in the space relative to the inner 20 and outer 22 knit tubes.

In FIG. 1, an outer most edge of the bill 16 of the visor assembly 14 is arranged to coincide with the brim 24, while the headband 18 is arranged intermediate between the brim 24 and the top closure at the crown 26 of the knit cap 12. The portion of the knit cap 12 between the brim 24 and the headband 18 is folded up and onto the back of the user's head, thus forming a crease line 24*a* that joins the crease line 24*b* along the edge of the bill 16.

FIG. 2 is a section view taken along the centerline of the hat 10 as configured in FIG. 1 FIG. 2 clearly illustrates an access aperture or "slit" 28 formed in the inner 20 knit tube that provides access into the annular space 30 between the inner 20 and outer 22 knit tubes. The access aperture 28 is structured to accept the visor assembly 14 and permit it to pass into the annular space 30 formed between the inner 20 and outer 22 knit fabric tubes. As illustrated, the outer most edge of the bill 16 portion of the visor assembly 14 is positioned along the inside of the crease of the brim 24, while the headband 18 is arranged intermediate between the brim 24 and the crown 26. The portion of the knit cap 12 between the brim 24 and the headband 18 is folded up, thus forming the crease line 24*a* that joins the crease line 24*b* along the edge of the bill 16. As FIG. 2 clearly illustrates, the headband 18 is movable inside the annular space 30 along a length of the inner 20 and outer 22 knit tubes.

Figure 3:
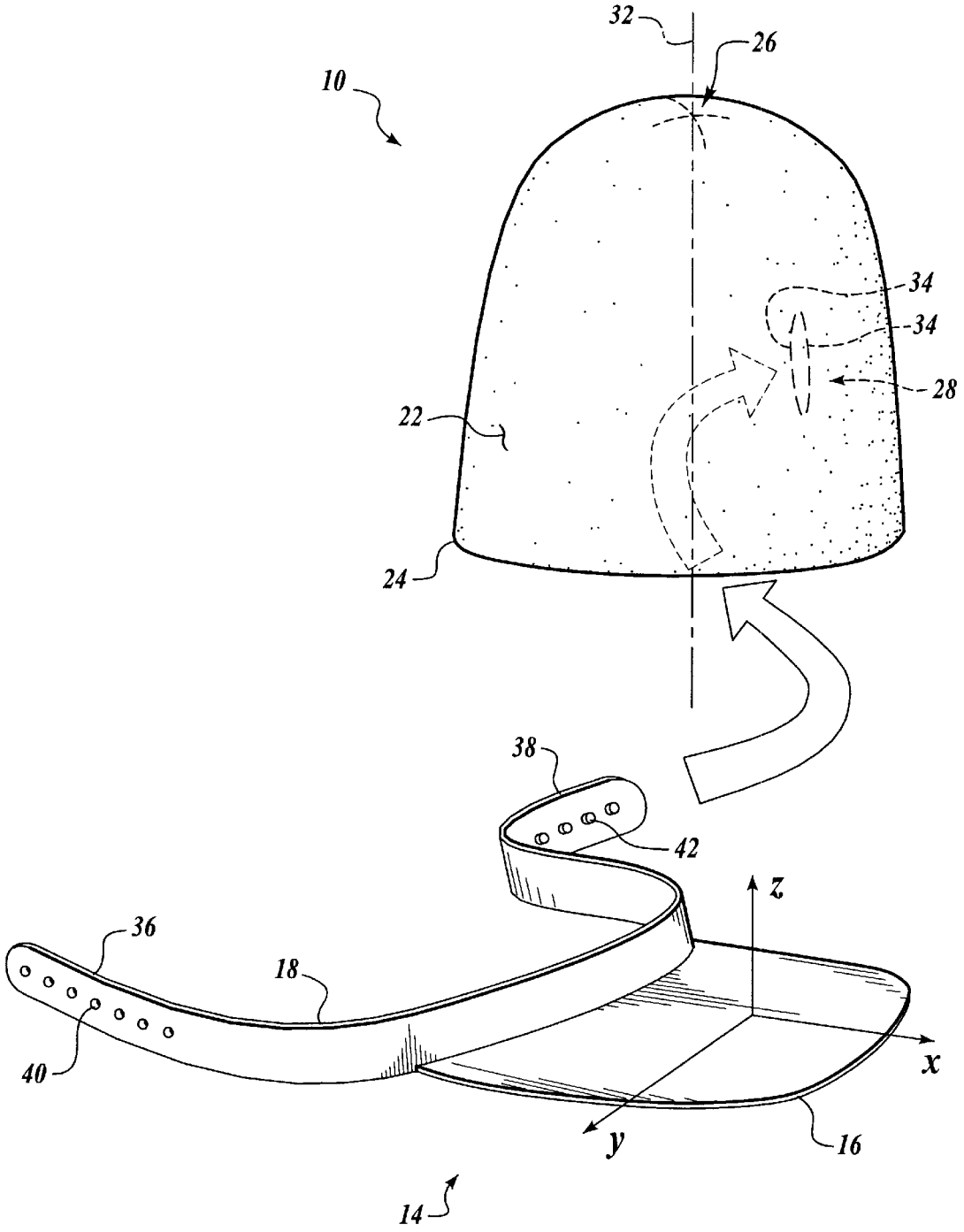
FIG. 3 illustrates the insertion of a visor assembly into a knit stocking cap according to one embodiment of the invention.

FIG. 3 illustrates the assembly of the visor assembly 14 into the knit stocking cap 12. According to one embodiment of the hat 10 of the invention, the access aperture or slit 28 is formed in the inner knit tube 20 and provides access into the annular space 30 between the inner 20 and outer 22 knit tubes at a position adjacent to, but spaced away from, the opening into the stocking cap 12 at the brim 24. For example, the access aperture 28 is a slit about 3 inches long, which is positioned about 4 inches away from the brim 24 and is substantially aligned with the circumference of the inner knit tube 20. In other words, the slit is substantially aligned with a longitudinal axis 32 of the stocking cap 12. However, the slit 28 is optionally aligned substantially perpendicular to the longitudinal axis 32. According to one embodiment of the invention, the access aperture 28 is a pair of lips 34 formed in the inner tube portion 20. The lips 34 are formed of the knit fabric and can be spread apart to provide the aperture 28 into the space 30 between the inner 20 and outer 22 knit tube portions. The edges of the lips 34 are optionally finished by stitching to protect the fabric against unraveling, similar to stitching a button hole. The slit 28 may also be formed with a roughly circular shape spaced away from the brim 24.

As further illustrated in FIG. 3, the visor assembly 14 is separable from the annular space 30 between the inner 20 and outer 22 knit fabric tubes and is independently usable as a conventional visor. According to one embodiment of the invention, the headband portion 18 of the visor assembly 14 is formed as an adjustable headband. For example, a portion of the headband 18 is formed as a belt with two interconnecting straps 36 and 38. One of the straps 36 includes a quantity of perforations 40 that cooperate with a quantity of pegs 42 (shown) or a buckle (not shown) on the other strap 38. The headband 18 is thus adjustable to fit a variety of head sizes. The interconnecting straps 36 and 38 are formed of any of several conventional materials, such as fabric, plastic, leather, or another suitable material. The adjustable portion of the headband 18 may also be formed by an elasticized band (not shown) attached to one strap 36 and releasably coupled to the other strap 38 by a fastener, such as a buckle, hook-and-eye, Velcro®, or another suitable fastener. The visor or bill portion 16 is formed as a thin crescent that is stiff in the x-y plane of the crescent and flexible perpendicular to the x-y plane in the z axis. The bill 16 is coupled to the headband 18 at a position intermediate between the straps 36 and 38. Alternatively, the bill 16 is formed integrally with the headband, for example, when the visor assembly is an integrally molded plastic unit.

FIG. 3 also illustrates one method for installing the visor assembly 14 within the annular space 30 formed between the inner 20 and outer 22 knit fabric tubes. One strap 36 or 38 (shown) of the headband 18 is inserted between the lips 34 into the aperture 28. The bill portion 16 and second strap 36 (shown) or 38 follow the first strap 38 through the aperture 28 into the annular space 30. The outer most edge of the crescent shaped bill 16 is positionable at an interior crease formed at the brim 24. The adjustable headband 18 is extended about an interior circumference of the annular space 30 between the inner 20 and outer 22 tubular thicknesses of the cap 12. Once installed, the headband 18 is selectably positionable along a length of the annular space 30 between the brim 24 and the crown 26. The inner 20 and outer 22 knit fabric tubes are thus configurable relative to the visor assembly 14 into different arrangements.

Figure 4:
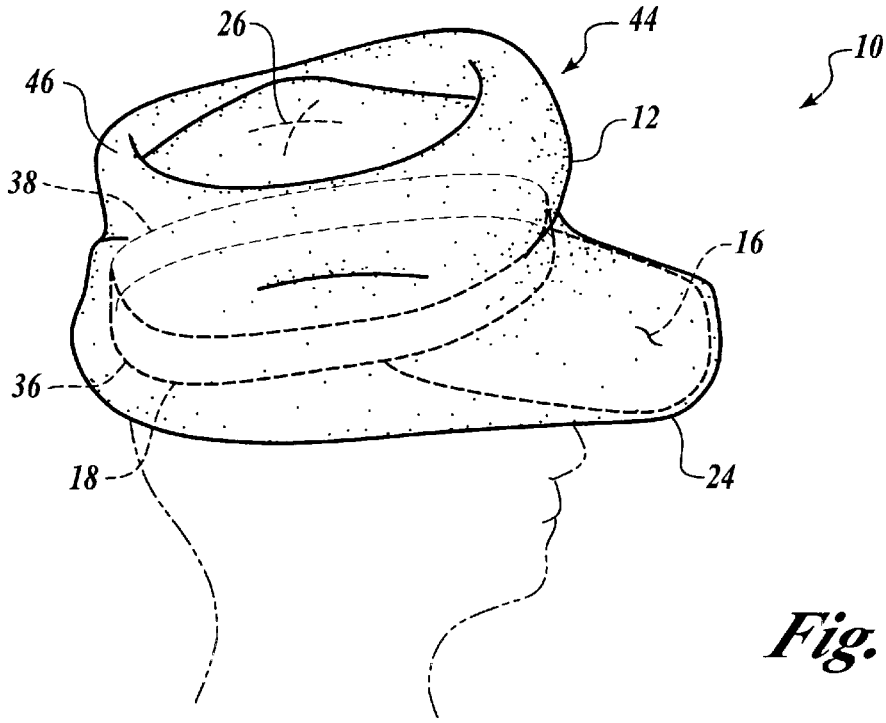
FIG. 4 illustrates one configuration of the hat of the invention.

FIG. 4 illustrates one of the ways that the hat 10 of the invention is multiply configurable. In FIG. 4, the outer edge of the bill portion 16 of the visor assembly 14 is again fit into the crease at the opening into the hat 10 adjacent to the brim 24*b*. The straps 36 and 38 are coupled in a configuration sized to comfortably fit the user's head and are moved down the length of the annular space 30 into the crease at the opening adjacent to the brim 24*a*. The remainder of the stocking cap 12 is "puffed" into a soft "stove pipe" configuration 44 with a roll 46 formed near the crown 26 to maintain the cylindrical stove pipe shape.

Figure 5:
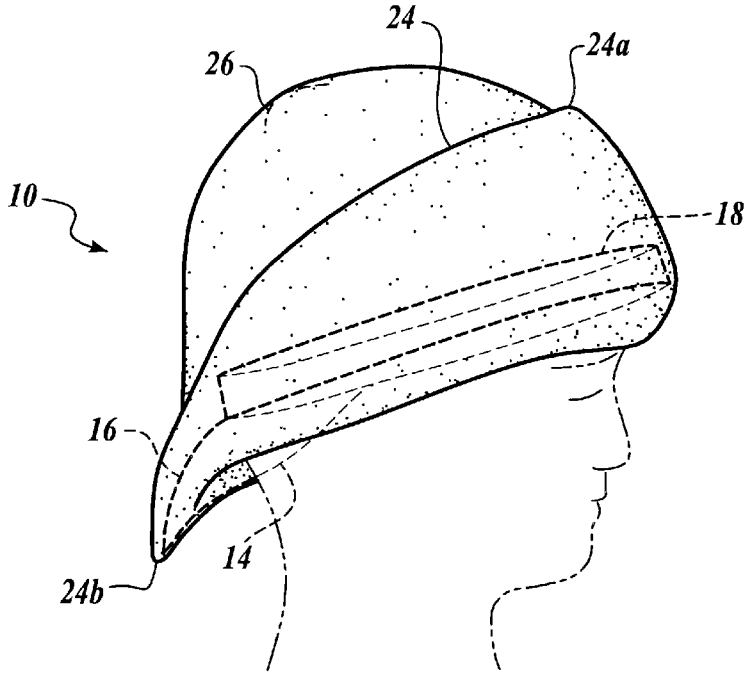
FIG. 5 illustrates another configuration of the hat of the invention.

FIG. 5 illustrates another of the ways that the hat 10 of the invention is multiply configurable. In FIG. 5, the outer edge of the bill portion 16 of the visor assembly 14 is again fit into the crease at the opening into the hat 10 adjacent to the brim 24*b*. The adjusted headband 18 is arranged intermediate between the brim 24*a* and the top closure at the crown 26 of the knit cap 12. The portion of the knit cap 12 between the brim 24*a* and the headband 18 is folded up toward the crown 26, thus forming a crease line 24*a* that joins the crease line 24*b* along the edge of the bill 16. The bill 16 of the visor assembly 14 is positioned over the user's ear, pointing generally toward the user's back and shoulder. Meanwhile, the portion of the knit cap 12 between the brim 24*a* and the headband 18 is folded upwardly onto the user's forehead.

Figure 6:
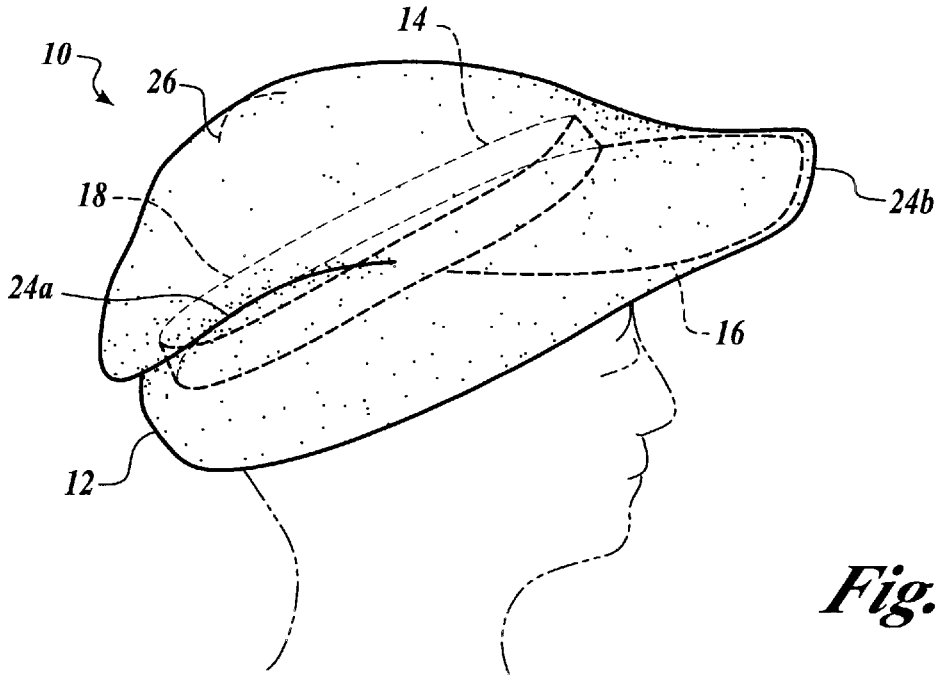
FIG. 6 illustrates still another configuration of the hat of the invention.

FIG. 6 illustrates still another of the ways that the hat 10 of the invention is multiply configurable. In FIG. 6, the outer edge of the bill portion 16 of the visor assembly 14 is again fit into the crease at the opening into the hat 10 adjacent to the brim 24*b*. The adjusted headband 18 is arranged at a position partway between the brim 24*a* and the top closure at the crown 26 of the knit cap 12. The portion of the knit cap 12 between the brim 24*a* and the headband 18 is folded up toward the crown 26, thus forming a crease line 24*a* that joins the crease line 24*b* along the edge of the bill 16. The bill 16 of the visor assembly 14 is positioned over the user's forehead, pointing generally forward. The portion of the knit cap 12 above the headband 18 is flattened down onto the top of the user's head. Meanwhile, the portion of the knit cap 12 between the brim 24*a* and the headband 18 is folded up onto the sides of the user's head similar to undeployed earflaps. The earflaps are optionally deployed as desired.

Figure 7:
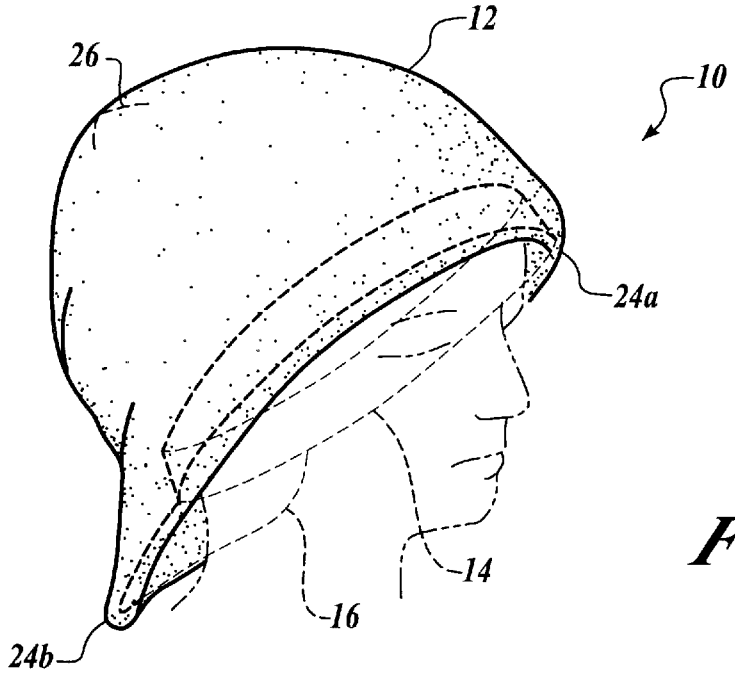
FIG. 7 illustrates another configuration of the hat of the invention.

FIG. 7 illustrates another of the ways that the hat 10 of the invention is multiply configurable. In FIG. 7, the outer edge of the bill portion 16 of the visor assembly 14 is again fit into the crease at the opening into the hat 10 adjacent to the brim 24*b*. The adjusted headband 18 is arranged at a position adjacent to the brim 24*a* opposite from the top closure at the crown 26 of the knit cap 12. The cap 12 is pulled down with the crown portion 26 positioned adjacent to the top of the user's head and the inner 20 and outer 22 tube portions covering the user's ears (not shown). The bill 16 of the visor assembly 14 is positioned over the user's neck, pointing generally backward. The headband 18 adjacent to the brim 24*a* is positioned over the user's forehead.

Figure 8:
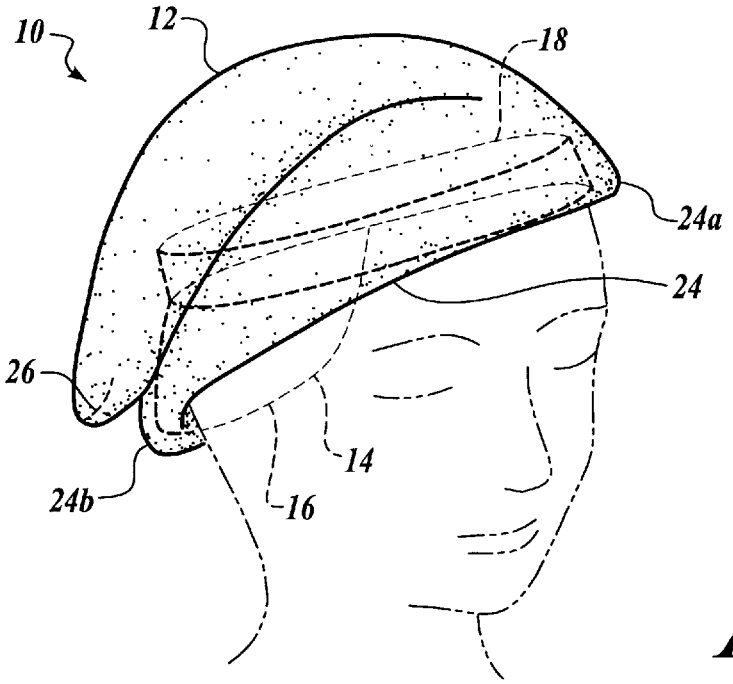
FIG. 8 illustrates yet another configuration of the hat of the invention.

FIG. 8 illustrates yet another of the ways that the hat 10 of the invention is multiply configurable. In FIG. 8, the outer edge of the bill portion 16 of the visor assembly 14 is again fit into the crease at the opening into the hat 10 adjacent to the brim 24*b*. The adjusted headband 18 is arranged at a position adjacent to the brim 24*a* opposite from the top closure at the crown 26 of the knit cap 12. The hat 10 is configured as a beret, having a close fitting headband 18 and a soft, full, flat top portion formed by the portion of the cap 12 between the headband 18 and the crown 26. In FIG. 8, the hat 10 is positioned with the bill 16 of the visor assembly 14 positioned generally over the user's ear, pointing generally toward the user's shoulder. The headband 18 adjacent to the brim 24*a* is positioned over the user's forehead and opposite ear. The portion of the cap 12 between the brim 24 and the crown 26 folded and laid over the user's opposite ear.

Figure 9:
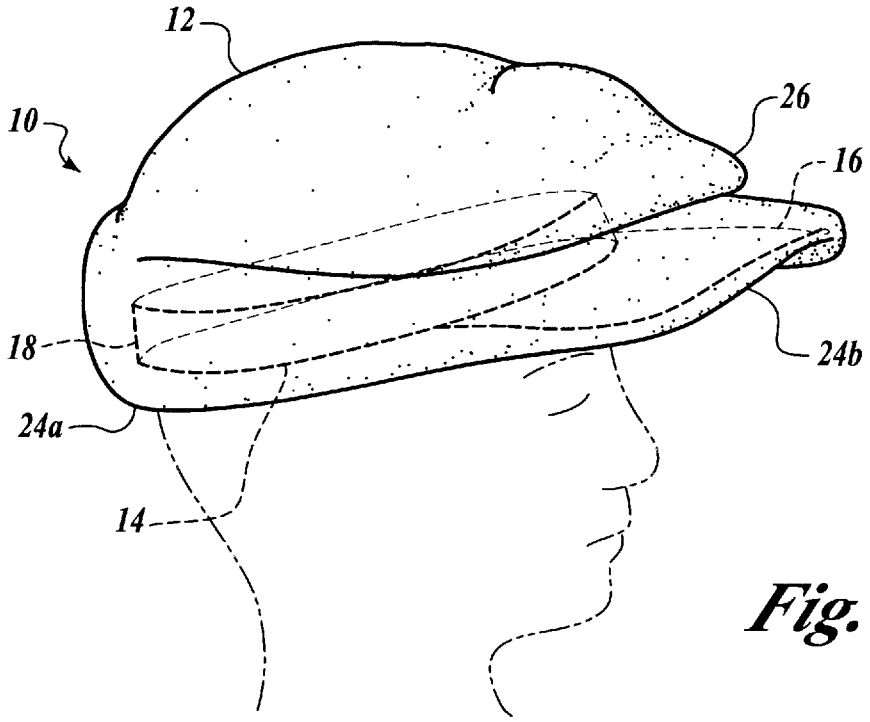
FIG. 9 illustrates still another configuration of the hat of the invention.

FIG. 9 illustrates still another of the ways that the hat 10 of the invention is multiply configurable. In FIG. 9, the outer edge of the bill portion 16 of the visor assembly 14 is again fit into the crease at the opening into the hat 10 adjacent to the brim 24*b*. The adjusted headband 18 is arranged at a position adjacent to the brim 24*a* opposite from the top closure at the crown 26 of the knit cap 12. The hat 10 is again configured as a beret, having the close fitting headband 18 and the soft, full, flat top portion formed by the portion of the cap 12 between the headband 18 and the crown 26. In FIG. 9, however, the hat 10 is positioned with the bill 16 of the visor assembly 14 positioned generally over the user's forehead, pointing generally forward. The headband 18 adjacent to the brim 24*a* is positioned around the back of the user's head. The portion of the cap 12 between the brim 24 and the crown 26 folded and laid forward over the bill 16.

Although the foregoing invention has been described in detail for purposes of clarity, certain modifications may be practiced within the scope of the appended claims. For example, although the present invention is illustrated as an article of stylable head wear configurable in a variety of different ways, it may also be configured in other ways not illustrated herein. Furthermore, the assembly methods may vary from those described herein. For example, visor assembly 14 is optionally installed within the annular space 30 while the knit cap 12 is under construction, before the closure at the crown 26 is sealed. Thus, the major intentions of the invention are realized, missing only the ability to separate the visor assembly 14 from the knit cap 12 for independent use.

I claim:

1. A multiply configurable hat comprising:

a visor assembly formed of a visor portion joined to a headband; and inner and outer knit fabric tubes joined at a first end to form a brim and joined at a second end to form a closure and a space formed between the inner and outer knit tubes, the inner tube formed with an access aperture structured to accept the visor assembly therethrough into an annular space formed between the inner and outer knit fabric tubes.

2. The hat of claim 1, wherein the visor assembly is installed in the space between the inner and outer knit fabric tubes and is movable therein relative to the inner and outer knit fabric tubes.

3. The hat of claim 2, wherein the headband portion of the visor assembly is formed as an adjustable headband.

4. The hat of claim 3, wherein the visor assembly is separable from the knit fabric tubes.

5. The hat of claim 3, wherein the inner and outer knit fabric tubes are configurable relative to the visor assembly into different arrangements.

6. The hat of claim 3, wherein the inner and outer knit fabric tubes are configurable relative to the visor assembly such that the visor portion arranged in proximity to the brim and the headband is movable along a length of the tube.

7. The hat of claim 6, wherein the visor is formed as a thin crescent that is stiff in the plane of the crescent and flexible perpendicular thereto.

8. An article of stylable head wear, comprising:

a double thickness knit fabric tube having a brim formed at one end of the tube and a closure formed at another end of the tube, an inner portion of the double thickness fabric tube interrupted with a slit providing access to an annular space formed between the double thicknesses of the fabric tube;

a crescent shaped visor coupled to an adjustable band and projecting therefrom, the visor and band installed within the space formed between the double thicknesses of the tube and selectively positionable relative thereto.

9. The article of claim 8, wherein the slit is formed substantially parallel with and spaced away the brim.

10. The article of claim 9, wherein the visor is positionable adjacent to the brim, and the band is simultaneously positionable in a plurality of positions along a length of the tube.

11. The article of claim 10, wherein the visor and band are removably installed within the fabric tube.

12. The article of claim 10, wherein the slit is formed as a pair of lips having edges finished by stitching.

13. A knit cap having a multiply positionable visor assembly, the cap comprising:

a double thickness knit cap having a space formed between inner and outer tube shaped portions joined along their circumferences at one end to form a brim about an opening into the tube that is sized to fit about a person's head, the inner and outer tube portions joined at an end opposite the opening to form a closure;

a pair of lips formed in the inner tube portion, the lips providing an aperture into the space between the inner and outer tube shaped portions; and a visor assembly removably inserted between the lips into the space between the inner and outer tube shaped portions and selectably positioned relative thereto.

14. The cap of claim 13, wherein the visor assembly includes an adjustable headband with a crescent shaped bill projecting therefrom.

15. The cap of claim 13, wherein the pair of lips is substantially aligned with the circumference of the inner tube shaped portion.

16. The cap of claim 15, wherein the pair of lips is positioned adjacent to but spaced away from the opening into the tube.

17. A method for forming a multiply configurable visored cap from a double thickness knit cap having an inner tubular thickness and an outer tubular thickness joined therewith at a crown portion, the inner and outer tubular thicknesses forming a space therebetween coextensive therewith and joined together to form at a brim portion opposite the crown portion an opening sized to fit onto a person's head in combination with a visor assembly having a crescent shaped bill projecting from a headband adjustable to fit a variety of head sizes, the method comprising:

installing the visor assembly into the space formed between the inner and outer tubular thicknesses, such that an outer most edge of the crescent shaped bill is positionable at an interior crease formed at the brim portion, and the adjustable headband attached thereto is extendable about an interior circumference of the space between the inner and outer tubular thicknesses and is selectably positionable along a length of the space between the brim portion and the crown portion.

18. The method of claim 17, further comprising forming a pair of lips in the inner tubular thickness of the cap.

19. The method of claim 18, further comprising finishing edges of the lips by stitching.

20. The method of claim 18, further comprising inserting the visor assembly between the pair of lips into the space between the inner and outer tubular thicknesses.

* * * * *